US006934975B2

(12) United States Patent
Hope et al.

(10) Patent No.: US 6,934,975 B2
(45) Date of Patent: Aug. 30, 2005

(54) DRAIN CLEANING DEVICE

(75) Inventors: Thomas Andrew Hope, Gastonia, NC (US); Gettys Haywood Knox, Union, SC (US); Robert James Sandee, Jamestown, NC (US)

(73) Assignee: American Technology Solutions, Inc, Walkertown, NC (US)

( * ) Notice: Subject to any disclaimer, the term of this patent is extended or adjusted under 35 U.S.C. 154(b) by 0 days.

(21) Appl. No.: 10/394,287

(22) Filed: Mar. 21, 2003

(65) Prior Publication Data

US 2004/0181863 A1 Sep. 23, 2004

(51) Int. Cl.[7] ..... E03D 9/00
(52) U.S. Cl. ..... 4/255.08; 4/255.06; 4/295
(58) Field of Search ..... 4/255.04, 255.06, 4/255.08, 255.09, 295

(56) References Cited

U.S. PATENT DOCUMENTS

| | | | | | |
|---|---|---|---|---|---|
| 506,872 | A | * | 10/1893 | Chase | 4/295 X |
| 655,888 | A | * | 8/1900 | O'Neil | 4/255.08 X |
| 964,954 | A | * | 7/1910 | Coles | 4/255.08 |
| 994,442 | A | * | 6/1911 | Coles | 4/255.04 X |
| 1,058,277 | A | * | 4/1913 | Tucker | 4/295 |
| 1,658,645 | A | | 2/1928 | McGee | |
| 1,894,711 | A | * | 1/1933 | Schacht | 4/255.04 X |
| 3,064,275 | A | * | 11/1962 | Allen | 4/255.04 X |
| 3,537,113 | A | | 11/1970 | Elzner | |
| 3,605,135 | A | | 9/1971 | Tan | |
| 3,770,204 | A | | 11/1973 | Schuster | |
| 4,756,480 | A | | 7/1988 | Fish | |
| 4,768,237 | A | | 9/1988 | Torti | |
| 5,787,516 | A | | 8/1998 | Davenport | |
| 6,019,537 | A | | 2/2000 | Hunt | |
| 6,163,895 | A | | 12/2000 | Davenport | |
| 6,295,659 | B1 | | 10/2001 | Sandness | |
| 6,345,410 | B1 | | 2/2002 | Baker | |

* cited by examiner

*Primary Examiner*—Robert M. Fetsuga
(74) *Attorney, Agent, or Firm*—Robert W. Pitts

(57) ABSTRACT

An adapter device, intended to be used with a conventional kitchen hose spray nozzle attached to a flexible hose, on most kitchen faucets can be used to clear drains. The adapter device can be mated or secured to the kitchen hose spray and will close the drain opening when the kitchen hose spray ejects a water spray into the drain to remove impacted matter in the drain.

7 Claims, 3 Drawing Sheets

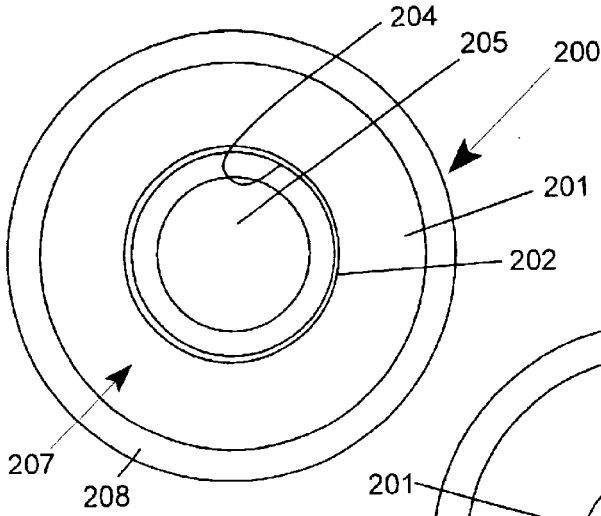
FIG 5
FIG 6
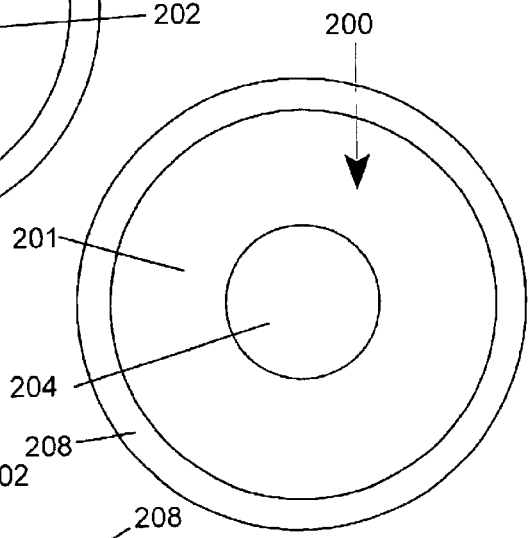
FIG 7
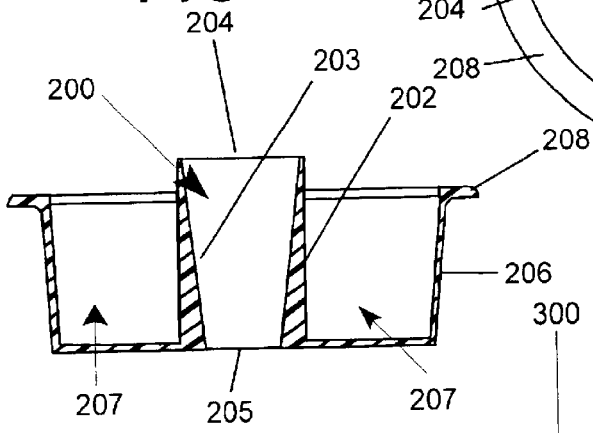
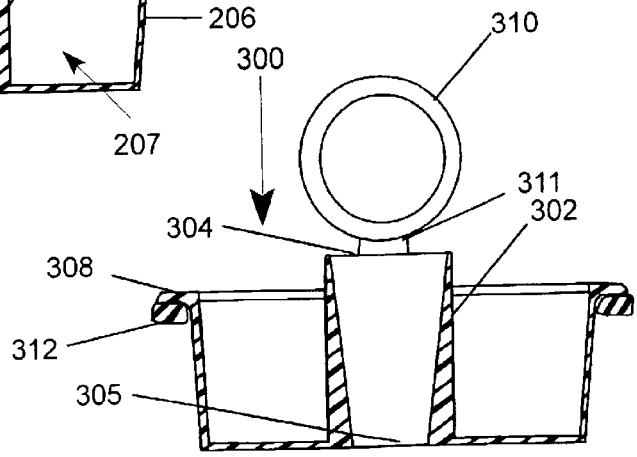
FIG 8

DRAIN CLEANING DEVICE

FIELD OF INVENTION

The present invention relates to clearing drains for kitchen and other types of sink systems, that are equipped with a spray nozzle that is attached to a flexible hose.

BACKGROUND OF THE INVENTION

The clearing of clogged or slow drains resulting from food and/or other particle build-up remains a time consuming and cumbersome task, notwithstanding the advent of modern conveniences. Even with the widespread availability of various plunger devices and chemical solvents that are designed to clear drains, clearing drains remains a time-consuming task and a frustrating experience.

Food particles and other foreign matter may often be released into the drain during the process of cleaning dishes and other objects in a sink. These food particles and other foreign matter may accumulate in the drains and result in a partially or completely clogged drain. Commonly, the kitchen sink is provided with a manually operable hose spray. Such sprays are normally stowed adjacent to the faucet and are connected to the faucet water supply by an extendable flexible hose. The hand spray may be manipulated to deliver a spray to the clogged drain. However, not all food particles and/or foreign matter can be cleared from the drain by the hand spray and resort must be made to other devices for removing more resistant deposits, blockages, and the like.

Plungers and chemical agents are commonly used as an adjunct to disassembling the plumbing to remove drain blockages. Plunging devices have the following disadvantages or limitatons:

1. Uses mechanical force to generate pressure therefore the attainable pressure is minimized
2. Plunger is used in applications other than kitchen sink and may introduce germs and bacteria into the sink area, if not properly cleaned.
3. If plunger is assisted by water pressure, requires an exterior hose and/or other water supply.
4. Requires additional storage.

Chemical agents have other disadvantages or limitations:

1. Slow to dissolve blockages.
2. May cause damages to plumbing fixtures
3. May irritate skin.
4. May irritate respiratory system if inhaled.
5. Contributes to increased waste water affluent.
6. May present safety hazard to children if not properly stored.
7. May lose effectiveness with age and if thrown out, releases chemicals into the soil and air.
8. Requires repeat purchases.

Accordingly, it would be desirable to provide a cleaning system which would utilize the convenience of the hose spray for clearing clogged drains, while allowing the hose spray to continue to be used for it's initial function of rinsing and spraying.

SUMMARY OF THE INVENTION

The present invention overcomes the above noted deficiencies by providing a convenient attachment that can be used with the existing hose spray to quickly and easily clear drains from partial and/or complete blockages. Such advantages are achieved by providing an opening for the hose spray to be inserted into the attachment. Once the clogged drain is sealed with this device and the hose spray is properly inserted into this device, the clogged drain can be quickly and easily cleared by pressing the water release valve and allowing the water to exert pressure to the particles that are clogging the drain. As the water exerts pressure to the particles that are creating the blockage, these particles are gradually forced from their location, resulting in the drain being cleared.

It will be greatly appreciated that the foregoing accessory device greatly simplifies the task of clearing blockages from drains by providing a system wherein the user may perform this function by using the existing hose spray.

Accordingly, it is an objective of the present invention to provide an accessory for a kitchen faucet hand spray that will allow it to be used in conjunction with the present invention to clear clogged drains, while not preventing it from being used for its initial purpose of spraying and rinsing.

It is further an objective of the present invention to provide a means of clearing blockages from drains in an environmentally friendly manner, without the use of chemical agents.

Yet another objective of the present invention is to provide a means of clearing clogged drains with a device that can be conveniently stored at or nearby the kitchen sink so that it is always readily available.

BRIEF DESCRIPTION OF THE DRAWING

The above objectives, features, and advantages of the present invention will become apparent to those skilled in the art upon reading the detailed description of the preferred embodiments, taken in conjunction with the accompanying drawings in which:

FIG. 5 is a top plan view of a molded version of an adapter member that can be mated with a spray nozzle but is not intended to be secured to the spray nozzle.

FIG. 6 is a bottom view of the adapter member shown in FIG. 5.

FIG. 7 is a cross section view of the adapter member of FIGS. 5 and 6 showing the one-piece construction of this adapter member.

FIG. 8 is an alternate embodiment, similar to the embodiment of FIGS. 5–7, which can also be used as a drain plug.

DESCRIPTION OF THE PREFERRED EMBODIMENTS

Figure 1:
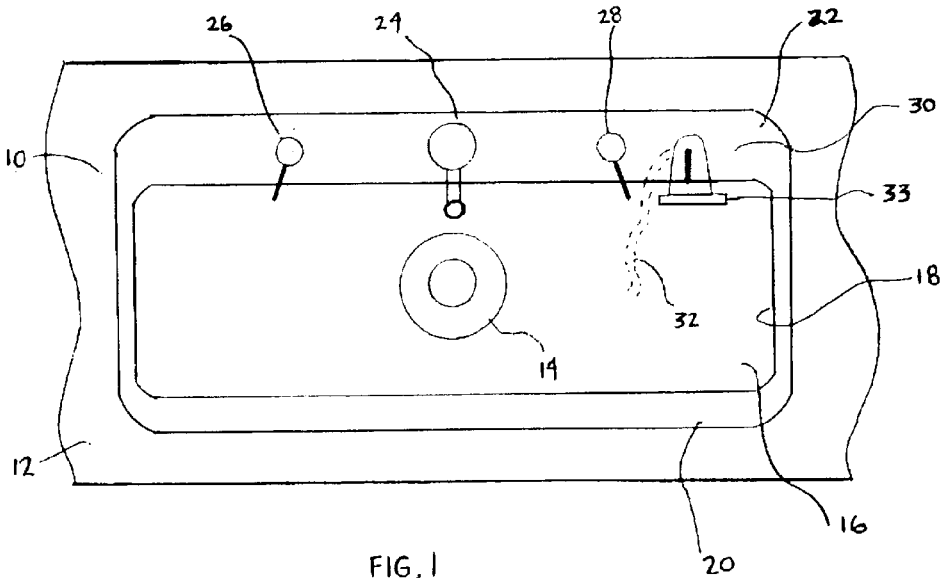
FIG. 1 is a fragmentary plan view of a kitchen counter having a sink provided with a faucet unit including a hose spray in accordance with the present invention.

Referring to FIG. 1 for purposes of describing a preferred embodiment of the present invention, there is shown a kitchen sink 10 conventionally mounted on a raised counter 12. The sink 10 is provided with a drain 14 mounted in the sink base 16 of a recessed tub 18. The sink 10 includes a top peripheral flange 20 surrounding the tub 18. The rearward side 22 of the flange 20 is provided with an upward projecting, rotatable faucet 24 for dispensing water into the tub 18 as controlled conventionally by faucet handles 26, 28 for delivering hot and cold water, or a mixture thereof, through the faucet 24. The sink 10 is also provided with an extendable hand held kitchen faucet hose spray unit 30 connected by an extendable hose 32 for dispensing water therethrough as controlled by valving associated with the handles 26, 28. The spray unit 30 can accept a clearing device that provides a system of clearing clogged drains in a quick and convenient manner as described in greater detailed below.

It will be appreciated that the present invention may be incorporated in all conventionally available sink and faucet designs including or adapted to include, conventional held spray units.

Figure 2:
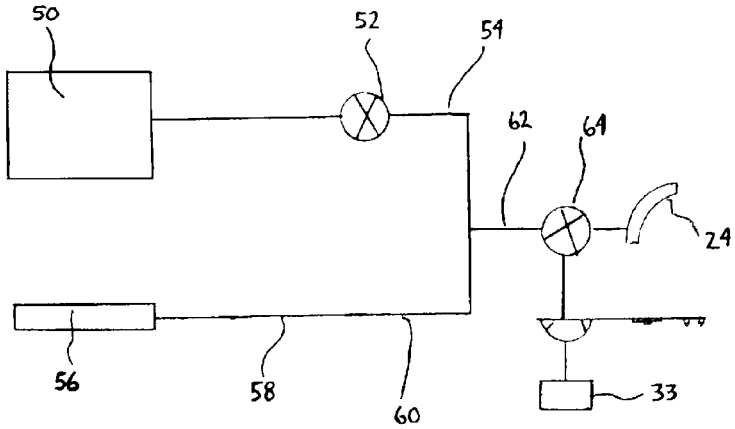
FIG. 2 is a schematic diagram of the faucet unit including the hose spray.

Referring to FIG. 2, there is shown the schematic flow diagram for a typical installation. Therein, the cold water supply 50 is fluidly connected to a cold water valve 52 at the handle 28 by line 54. The hot water supply 56 is fluidly connected to a hot water valve 58 at the faucet handle 26 by line 60. The lines 54, 60 are commonly connected to line 62 terminating at the faucet 24 and having a valve 64 interposed therein. The valve 64 is connected to the hose 32 leading to the spray unit 30. The spray unit 30 includes a hand operated internal valve operative to cause the valve 64 to switch positions to divert water to the hand spray 30 at a temperature and flow rate determined by the setting of the valves 52, 58. While the foregoing has been described with reference to a two-handled faucet it will be appreciated that the spray unit is also compatible with conventional single handle designs.

Figure 3:
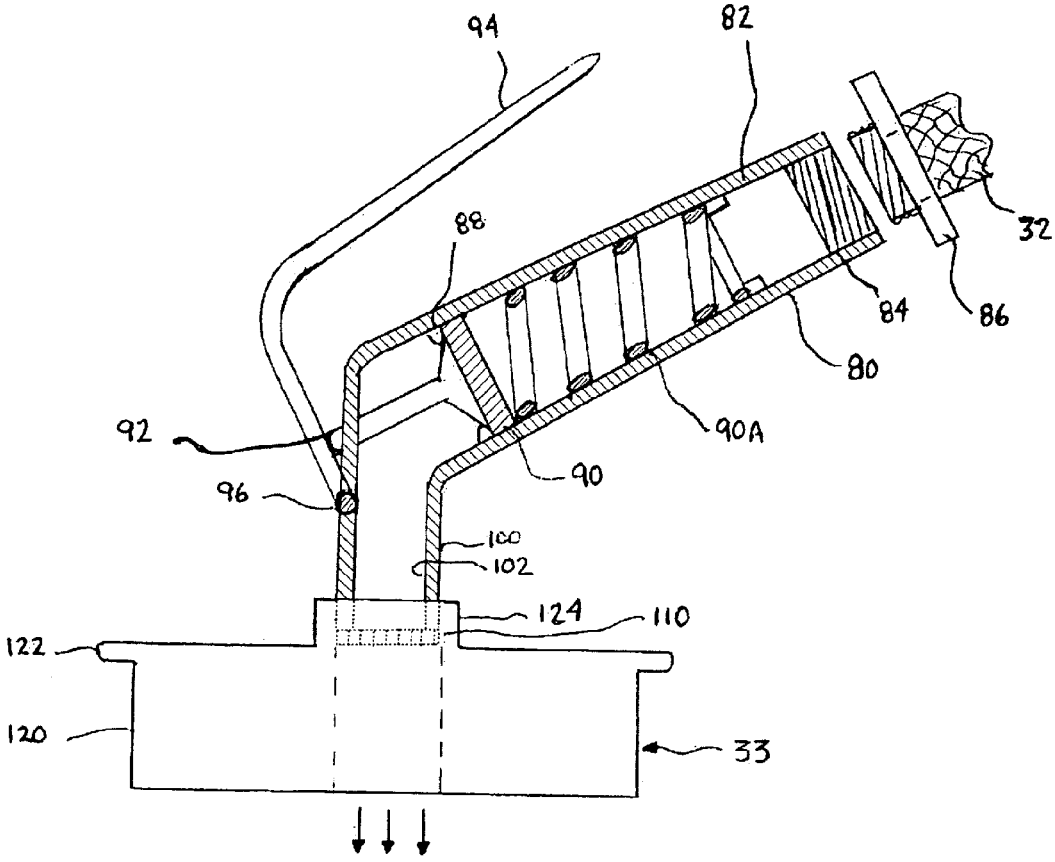
FIG. 3 is a partially sectioned side elevation view of the hose spray in accordance with the present invention.

Referring to FIG. 3, the accessory unit 33 permits the spray unit to provide drain clearing functions, while allowing it to continue to be used at other times for its initial purpose of spraying and rinsing.

The spray unit 30 typically includes an elongated body member 80, has a central fluid conduit or passage 82 formed therein extending between a front or first end and a rear or second end. Spray unit 30 is and rearwardly terminated at an interiorly thread section 84 on the second end to which the threaded terminal nut 86 of the hose 32 is threaded by connected to fluidly connect the hose 32 with the flow passage 82. The passage 82 includes a central valve seat 88. A valve 90 engages the valve seat 88 as biased by a coiled spring 90A. A valve rod 92 connected to the valve 90 projects outwardly of the body 80 and is connected to an operating handle 94 pivotally connected to the body 80 at connection 96.

The hand spray unit 30 includes a general cylindrical head section 100 disposed at an angle on the first end of the main body 80. The head section 100 includes an interior flow passage 102 fluidly communicating with passage 82 at the seat 88. The head section 100 includes an apertured distribution nozzle 110 suitably fixed or removeably connected thereto at the lower end thereof. Accordingly in operation the hand spray 30 functions in a conventional manner to provide a directed rinsing spray for kitchen articles and utensils to be cleaned. More particularly, an operator removes the spray unit 30 from its nested position of the sink flange and locates the spray unit at a desired position as accommodated by the extendable hose 32. As desired, the operator depresses the lever 94 to open the internal valve 90 which in turn switches the line valve 64 to direct a rinsing spray serially through the hose 32, passage 82, passage 102 and outwardly through the apertures in the nozzle 110.

Figure 4:
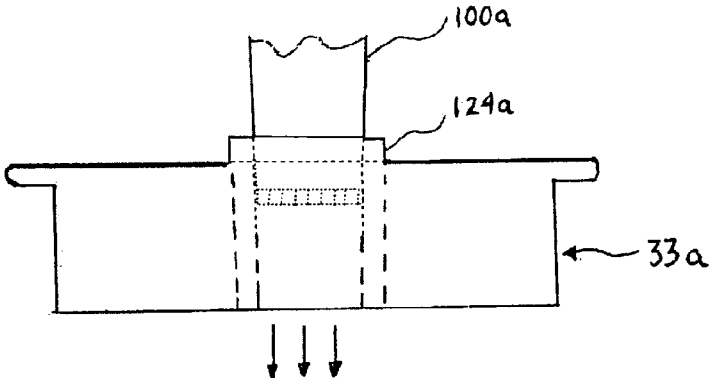
FIG. 4 is a side view of the present invention.

The accessory unit 33 is adapted to be provided as an integral feature of the hose spray 30 shown in FIG. 3, or as a retrofit accessory as shown in FIG. 4. The lower end of the head section 100 is provided with an exterior threaded portion for connection with the unit 33. The accessory unit 33 is also provided with an exterior threaded portion for connection with the lower end of the head section 100 of the spray unit 30. The base 120 of the accessory unit 33 includes a circular flange or lip 122 and the cylindrical projecting hub 124 are centrally aperatured to define a flow opening substantially the size of the nozzle 110 and for rinsing and/or drain clearing functions, water flows through the unit substantially without obstruction. When the accessory unit 33 is adapted to be provided as an integral feature of the hose spray 30 as shown in FIG. 3, the upper end of the hub 124 is interiorly threaded for connection to the exterior thread of the head section 100 thereby functionally integrating the adapter with the spray unit 30. The base portion 120 of the accessory unit 33 are adapted to fit into the drain opening of the sink. When the accessory unit 33 is adapted to be used in conjunction with the spray unit 30, but not as an integral feature of the spray unit 30, the projecting hub 124 of the accessory unit 33 is adapted to allow the head section 124 of the spray unit 30 to fit securely into the projecting hub 124 of the accessory unit 33 on an as needed basis.

When the accessory unit 33 is adapted to be provided as an integral feature of the hose spray unit 30 as shown in FIG. 3, the head section 110 of the hose spray unit 30 should be secure enough that loosening of the adapter during normal rinsing motions is effectively resisted. Accordingly, it will be appreciated that many similar mountings may be provided. For instance, as shown in FIG. 4, the terminal end of the head section 100A may be received within a complimentary shaped counterbore in the adapter 124A and secured thereto by a suitable adhesive or the like. Other locking mechanical systems may be employed; however, each should be resistant to the forces applied thereto during operation. When the accessory unit 33 is adapted to be provided as an integral feature of the hose spray unit 30, mere compressive joints and interlocking rib and groove connections may be unsatisfactory.

When the accessory unit 33 is adapted to be used in conjunction with, but not as an integral feature of, the hose spray unit 30 as shown in FIG. 4, the accessory unit 33*a* is provided with a generally cylindrical or telescoping adapter 124*a* that allows the head section 100*a* of the hose spray unit 30 to be inserted into the hub 124*a* of the accessory unit 33*a* and held there securely during the drain clearing process. Accordingly, it will be appreciated that many similar adaptations may be provided. For instance, the hub 124 of the accessory unit 33 may be in a rectangular shape to allow the head section 100 of the hose spray unit 30 to be inserted in to the hub 124 of accessory unit 33 and held there securely during the drain cleaning process. Other systems and/or adaptations may be employed; however, each should allow for the head section 100 of the hose spray unit 30 to be inserted into the hub 124 and held there during the drain cleaning process.

In operation with the accessory unit 33 mounted on the hose spray unit 30, two distinct modes may be effected.

Mode I: Normal rinsing may be conventionally provided by extending the hand spray unit 30 from it's original stowed position on the sink 14, actuating the lever 94, and directing the resultant water spray as desired.

Mode II: A drain clearing mode may be provided by inserting the base portion 120 of the accessory unit 33 into the drain opening 14 of FIG. 1, and depressing the lever 94 of the hose spray unit 30 to open the internal valve 90 which in turn switches the line valve 64 to direct a stream of water serially through hose 32, passage 82, passage 102, and outwardly through the apertures in the nozzle 110. By sealing the drain opening 14 in the sink with the accessory unit 33 and depressing the lever 94 of the hose spray unit 30 directing a stream of water serially through the hose 32, passage 82, passage 102 and outwardly into the drain, water exerts pressure onto the blockage/clog in the drain and forcing it from it's lodged position, thus clearing the drain.

Another embodiment of the accessory drain cleaning apparatus in the form of a one-piece molded adapter member 200 is shown in FIGS. 5–7. This adapter member can be used with a hand held spray nozzle 30, but is not intended to be attachable to the nozzle. Adapter member 200 has a generally circular adapter base 201 with an annular hub or cylindrical projection 202 extending upwardly from the base upper surface. As shown in FIGS. 7 and 8, this circular base 201 is generally flat. The base 201 can be large enough to fit over conventional kitchen sink drains or it can be sized to fit into a standard drain opening. In either case the adapter member will close off or seal a drain with which it is used except for the central fluid passage extending through the hub or cylindrical projection 202. The upwardly projection annular hub 202 has an inner conical surface 203, which diverges in the upward direction, so that its upper open end 204 has a larger diameter than the opening 205 in the base 201. The adapter 200 also includes an annular rim 206 spaced radially outwardly from the cylindrical annular hub 202 and separated therefrom by a toroidal gap 207. As shown in FIGS. 5–6, the base 201 forms a transverse wall extending between the hub, or cylindrical protection, 202 and the annular rim 206. As seen in FIGS. 6 and 7, the height of the hub 202 relative to the base 201 is only slightly greater than the height of the annular rim 206 so the toroidal gap extends for the complete height of the circular rim and for the maiority of the height of the cylindrical protection above the flat base 201. An annular lip 208 is formed on the top of the annular rim 206. In this embodiment, the height of the annular hub 202 is greater than the height of the annular rim 206. The annular rim 206 and the lip 208 can be sized so that the adapter member 30 can be inserted into a standard drain with the lip 208 preventing the adapter member 30 from being inserted completely into the drain. The lip 208 would also close the drain in that configuration. Alternatively the flat adapter base 201 can be positioned over the drain and held down to close the drain. The conical surface 203 is sized so that the head of a spray nozzle 30 can be inserted into the top of the annular hub 202, but the hub opening is small enough so that the spray nozzle 30 cannot be inserted completely through the central fluid passage formed by the interior of the annular hub 202. The conical surface 203 will also provide a reaction surface against which the spray nozzle 30 can be downwardly pressed. This downward force will also hold the adapter member 200 securely in or over the drain so that a stream of water can be sprayed into the drain to dislodge tightly impacted material in the drain. Although the fluid passage is formed by a conical surface, comparison of FIGS. 5 and 6 with FIGS. 7 and 8 shows that a cross section through the cylindrical protection will have a circular cross section with the bore forming the fluid passage also having a circular cross section shape. The adapter member 200 will also serve to prevent the water spray or stream from backing up into the sink to enhance the effect of the stream injected into the drain.

The adapter member 200 shown in FIGS. 5–7 is intended to be a separate member that can be mated with the spray nozzle 30 when needed, but which will not be attached to the spray nozzle 30. Of course the molded adapter member 200 could include a mechanical connection, such as treads on the interior of the annular hub 202, so the adapter member 200 can be secured to the spray nozzle 30. Alternatively, an adhesive could be used to connect the two members.

FIG. 8 shows another embodiment that is similar in many ways to the adapter member 200. Adapter member 300 includes a stopper 310 that can be used to close the top of the annular hub 302. Stopper 310 can close the central fluid passage so that the accessory drain cleaning apparatus comprises a plug for the kitchen drain when not mated to the spray nozzle, the stopper 310 being joined to the adapter member by a living hinge 311. In this molded embodiment, the stopper 310 is attached to the hub 302 by a flexible integral living hinge 311 so that the stopper can be rotated between a position closing the fluid passage between end 304 and 305 through the hub 302 and the open position shown in FIG. 8. When the adapter member 300 is in the closed position it can also function as a drain plug. The stopper 310 can be moved to the open position to accept a spray nozzle 30 in the same manner as the embodiment of FIGS. 5–7. A sealing member 312 can be added to the exterior of annular rim 306 along the bottom surface of lip 308 for sealing the drain.

The foregoing present invention has been shown and described herein with reference to what is considered practical and preferred embodiments. It will be recognized however that departures may be made therefrom within the scope of the invention and that obvious modifications will occur to persons skilled in the art.

We claim:

1. An accessory drain clearing apparatus adapted for use with a separate spray nozzle at one end of an extendable hose to clean a sink drain, said accessory drain clearing apparatus comprising:

a molded adapter member against which the spray nozzle can be pressed when positioned in a drain opening and being engagable with the separate spray nozzle adjacent to the drain opening and disengagable therefrom adjacent to the drain opening and having a central fluid passage fluidly communicable with said nozzle and permitting the passage of water therethrough, the central fluid passage extending through a cylindrical projection extending upwardly from a flat generally circular adapter base, the cylindrical projection being adapted to capture water spray from the spray nozzle and forming a conical surface engagable with the spray nozzle adjacent the drain opening, the conical surface being located adjacent to the adapter base, the base extending beyond the cylindrical projection and beyond the spray nozzle when in engagement with the cylindrical projection, the base including a lower surface for closing the drain opening except through the central fluid passage when the central fluid passage is aligned in communication with the drain opening, the conical surface continuously diverging upwardly from the lower surface of the base to an upper end of the cylindrical projection and wherein an annular rim extends upwardly from the adapter base defining a toroidal gap between a portion of the cylindrical projection containing the conical surface and the annular rim, the accessory drain cleaning apparatus improving the effectiveness of water ejected by the spray nozzle through the central fluid passage in removing impacted matter from the sink drain.

2. The accessory drain cleaning apparatus of claim 1 wherein a lip extends radially outwardly from an upper end of the annular rim radially beyond the flat circular base.

3. The accessory drain cleaning apparatus of claim 1 including a stopper for closing the central fluid passage so that the accessory drain cleaning apparatus comprises a plug for the kitchen drain when not mated to the spray nozzle, the stopper being joined to the adapter member by a living hinge.

4. The accessory drain cleaning apparatus of claim 1 wherein the adapter member has a generally circular cross section.

5. The accessory drain cleaning apparatus of claim 1 wherein the central fluid passage has a generally circular cross section and is configured for receipt of the spray nozzle.

6. An accessory drain clearing apparatus for use with a separate spray nozzle at one end of an extendable hose to clean a sink drain, said accessory drain clearing apparatus comprising:

a one piece molded member, against which the spray nozzle can be pressed when positioned in a drain opening, having a circular, flat base with a lower surface comprising the lowermost part of the accessory drain clearing apparatus;

a cylindrical projection extending upwardly from the flat base and centered relative to the flat base;

a fluid passage extending through the cylindrical projection to permit water to be sprayed through the accessory drain clearing apparatus;

an circular rim extending upwardly from the periphery of the flat base and being concentric with the cylindrical projection:

a toroidal gap formed between the cylindrical projection and the circular rim, the toroidal gap extending for the complete height of the circular rim and for the majority of the height of the cylindrical projection above the flat base;

the accessory drain clearing apparatus being positionable relative to a drain so that the flat base closes the drain except for communication through the fluid passage to improve the effectiveness of water ejected by the separate spray nozzle through the central fluid passage in removing impacted matter from the drain and, wherein the cylindrical passage forms a surface for engaging the spray nozzle adjacent the upper end of the fluid passage so that the accessory drain cleaning apparatus can be pressed down by pressure on the spray nozzle to close off the drain as water is sprayed through the fluid passage by the spray nozzle, and wherein the central fluid passage is formed by a conical surface extending upwardly from the flat base and diverging toward an upper end of the cylindrical projection form the surface for engaging the spray nozzle.

7. The accessory drain cleaning apparatus of claim 6 wherein a circular lip extends outwardly from an upper edge of the rim to form a stop surface when the accessory drain cleaning apparatus is used with a drain large enough to receive the flat base and the circular rim.

* * * * *